US010773936B2

(12) United States Patent
Hudson

(10) Patent No.: US 10,773,936 B2
(45) Date of Patent: Sep. 15, 2020

(54) MOBILE LIFT COLUMN CABLE SUSPENSION BRACKET AND ASSOCIATED METHOD

(71) Applicant: ARI Phoenix, Inc., Lebanon, OH (US)

(72) Inventor: Gareth Y. Hudson, Terrace Park, OH (US)

(73) Assignee: ARI Phoenix, Inc., Lebanon, OH (US)

( * ) Notice: Subject to any disclaimer, the term of this patent is extended or adjusted under 35 U.S.C. 154(b) by 333 days.

(21) Appl. No.: 15/967,640

(22) Filed: May 1, 2018

(65) Prior Publication Data

US 2018/0319644 A1 Nov. 8, 2018

Related U.S. Application Data

(60) Provisional application No. 62/501,964, filed on May 5, 2017.

(51) Int. Cl.

| | |
|---|---|
| ***B66F 7/28*** | (2006.01) |
| ***B66F 3/46*** | (2006.01) |
| ***B66F 13/00*** | (2006.01) |
| ***B66F 7/20*** | (2006.01) |

(52) U.S. Cl.

CPC ..... *B66F 7/28* (2013.01); *B66F 3/46* (2013.01); *B66F 7/20* (2013.01); *B66F 13/00* (2013.01)

(58) Field of Classification Search

CPC ..... B66F 3/46; B66F 7/20; B66F 7/28

See application file for complete search history.

(56) References Cited

U.S. PATENT DOCUMENTS

| | | | | |
|---|---|---|---|---|
| 6,315,079 | B1 | 11/2001 | Berends et al. | |
| 6,634,461 | B1 | 10/2003 | Baker | |
| 9,580,284 | B2 * | 2/2017 | Helmich | B66F 3/46 |
| 9,611,128 | B2 | 4/2017 | Van Houten et al. | |
| 9,902,599 | B1 * | 2/2018 | Veresko | B66F 1/00 |
| 2002/0175319 | A1 * | 11/2002 | Green | B66F 7/04 254/45 |
| 2004/0031953 | A1 * | 2/2004 | Leggett | B66F 3/46 254/1 |
| 2005/0279581 | A1 * | 12/2005 | Koch | B66F 13/00 187/222 |
| 2007/0283854 | A1 * | 12/2007 | Taylor | B66F 7/28 108/42 |
| 2015/0232309 | A1 * | 8/2015 | Jaipaul | B66F 7/04 414/800 |
| 2016/0244204 | A1 * | 8/2016 | DeBattiste | B66F 3/24 |
| 2017/0369291 | A1 * | 12/2017 | Quickfall | B66F 3/46 |
| 2018/0265338 | A1 * | 9/2018 | Motley | B66F 7/10 |

OTHER PUBLICATIONS vehicleservicepros.com, Exclusive Vehicle Lift Guide, 16 pgs., 2013.

* cited by examiner

*Primary Examiner* — Minh Truong

(74) *Attorney, Agent, or Firm* — Wood Herron & Evans LLP

(57) ABSTRACT

A bracket can be mounted to a mobile lift column. The bracket may include one or more hangers on which the cables extending between the individual mobile lift columns may be suspended. In this way, the cables are elevated from the floor and work surface and no longer present a tripping hazard for personnel in the work area nor an obstacle over which equipment must roll during the servicing of the vehicle. Advantageously, the brackets may be individually mounted to each lift column as original equipment when the column is purchased or as a retrofit improvement to existing lift columns.

10 Claims, 3 Drawing Sheets

MOBILE LIFT COLUMN CABLE SUSPENSION BRACKET AND ASSOCIATED METHOD

This claims the benefit of U.S. Provisional Patent Application Ser. No. 62/501,964, filed May 5, 2017 and hereby incorporated by reference in its entirety.

BACKGROUND OF THE INVENTION

This invention relates to a coordinated lift system. In particular, this invention relates to a coordinated lift system having at least two lift mechanisms that communicate by signals carried by cables to coordinate the raising and lowering of a vehicle.

The need to lift a vehicle from the ground for service work is well established. For instance, it is often necessary to lift a vehicle for oil changes, brake inspections, exhaust work and other automotive maintenance. Traditionally, lifting a vehicle has been accomplished through the use of equipment that is built-in to the service facility. These built-in units are located at a fixed location at the service facility and adapted to contact the vehicle frame to lift the vehicle from the ground. However, built-in units are very expensive and sometimes impractical due to their lack of mobility.

To increase mobility and reduce the need to invest in permanent lifting equipment, a device commonly known as a mobile lift column was developed. Mobile lift columns are available from the owner of this invention, Ari-Hetra, www.ARI-HETRA.com. A set of mobile lift columns is typically used to independently engage each of the tires and lift the vehicle from the ground. To lift a vehicle in a generally level orientation with independent lift columns, a user must go back and forth between each lift column to incrementally raise each lift until the vehicle reaches the desired height or involve several people. While this type of lifting column is less expensive and provides more mobility than the built-in units, using a number of independent lift columns to lift the vehicle is a time consuming and tedious process.

Another type of system 1 for lifting a vehicle 3 using multiple lifting columns 5 is shown in FIG. 3 and includes a number of cables or wires 7 to connect the lifting columns 5 to one another. The cables or wires 7 that are connected between the columns 5 allow the vehicle 3 to be raised or lowered in a uniform fashion. However, this system 1 also suffers from a number of drawbacks and deficiencies. For instance, the cables and wires 7 used to connect the individual columns extend across the floor 9 and are looped within the working area. The presence of the cables and lines 7 on the ground in the work area poses a tripping hazard to people working near the vehicle 3. Vehicles also often drive over these connecting cables 7 causing damage.

Some newer lifting systems utilize wireless communication among the individual lifting columns to coordinate their operation. However, such wireless systems are not an option in many cases due to the added cost of purchasing an entire set of lifting columns equipped with wireless communication capabilities. Many users are not willing to replace sets of existing and operational lift columns, but wish to alleviate the tripping and other hazards associated with the network of cables connecting the lifting columns.

Accordingly, there remains a need for a mobile lift system that is able to coordinate the raising or lowering of a vehicle with cables connecting the individual lift columns while avoiding the tripping and other hazards of such systems. This invention satisfies these and other needs.

SUMMARY OF THE INVENTION

In various embodiments, this invention is directed to a bracket which can be mounted to a mobile lift column. The bracket may include one or more hangers on which the cables extending between the individual mobile lift columns may be suspended. In this way, the cables are elevated from the floor and no longer present a tripping hazard for personnel in the work area nor an obstacle over which equipment must roll during the servicing of the vehicle. Advantageously, the brackets may be individually mounted to each lift column as original equipment when the column is purchased or as a retrofit improvement to existing lift columns.

According to various embodiments of a bracket according to this invention, one or more hangers may be included on each bracket. Each hanger may take the form of a pedestal having a head thereon extending from a portion of the bracket. The bracket may be generally L-shaped with a vertical leg of the L-shaped bracket extending downwardly from an upper end of the lift column and the horizontal leg of the bracket secured to the top portion of the lift column. The cable may be trained around one or more hangers on the bracket and thereby elevated from the ground in the work area. Multiple hangers may be included on the bracket so as to generate sufficient friction between the hangers and the cable so that the cable does not slide relative to the bracket once it is suspended.

Another aspect of this invention is a method for suspending the cables between a set of multiple mobile lift columns. The method may include retrofitting a mobile lift column with a bracket having one or more hangers upon which the cable is suspended.

In various aspects of this invention, a set of multiple mobile lift columns may be utilized to lift a vehicle for service of the vehicle and alleviate a major source of injury and issues associated with the cable extending between the adjacent lift columns.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

Figure 1:
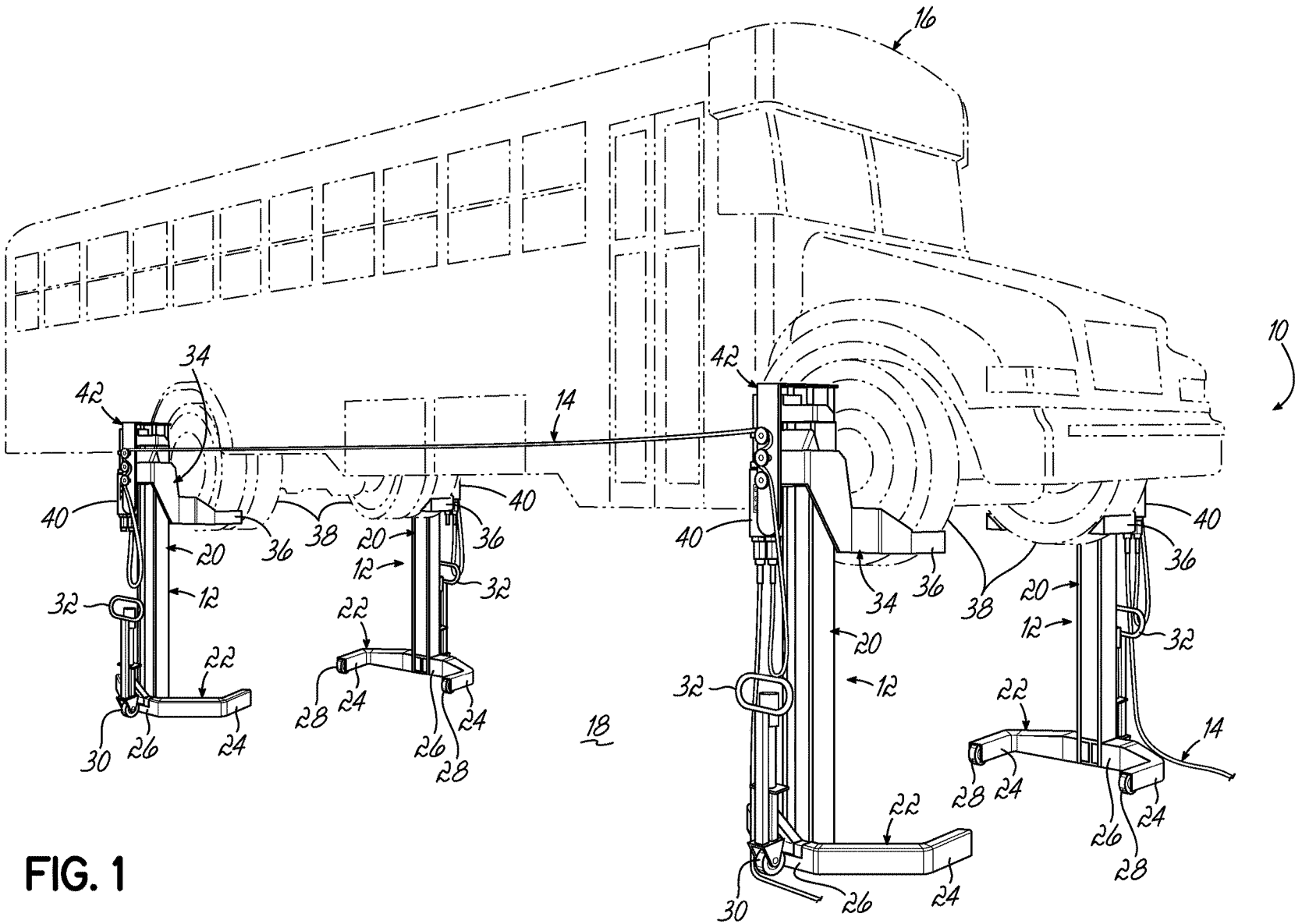
FIG. 1 is a perspective view of a vehicle raised off the ground by a number of lift columns and a cable extending serially among the lift columns is supported off of the ground by a bracket on each lift column according to one aspect of this invention.

Referring now to the drawings in detail, and initially to FIG. 1, a lift system 10 constructed in accordance with a first embodiment of this invention is shown. Generally, the lift system 10 includes four lift columns 12 that communicate by signals carried by cables 14 to coordinate the movement of a vehicle 16 relative to a ground surface 18. It will be understood and appreciated that the number of lift columns 12 used in this invention may vary depending on the type of vehicle 16 being lifted. For instance, six lift mechanisms or columns may be used to lift a three-axle vehicle for service. Furthermore, it will be understood that this invention is not limited for use with lift systems for vehicles, but also may be used to raise or lower other objects relative to the surface.

Each lift column 12 includes an upstanding post 20 supported by a base 22. The base includes a pair of legs 24 that are coupled to one another by a cross piece 26. A pair of front wheels 28 are rotatably coupled with an end portion of the legs 24. Further, a rear wheel 30 is rotatably coupled adjacent to the cross piece 26. The wheels 28, 30 are adapted to allow each lift column 12 to be rolled along the surface 18 and placed in a position to support the vehicle 16. A handle 32 is coupled to the wheel 30, and may be moved about a pivot point established adjacent to the wheel 30. The handle 32 may be used to place wheels 28, 30, in contact with the surface 18 so that the lift column 12 may be rolled into position. Once the lift column 12 is in position, the handle 32 may then be used to raise the wheels 28, 30, so that they are no longer in contact with the surface 18. The lift column 12 is thereby placed in a stable position for raising and lowering vehicle 16.

The post 20 is mounted to the cross piece 26 and extends upwardly from the surface 18. The lifting column 12 also includes a carriage 34 that is slidably coupled to the post 20. Specifically, the carriage 34 engages a portion of the post 20 to enable the carriage 34 to move longitudinally with respect to the post 20. Carriage 34 further includes a pair of forks 36 that extend outwardly and are adapted to support a portion of vehicle 16. In particular, forks 36 are adapted to support the vehicle at each wheel 38, but it will be understood that carriage 34 may also be adapted to support the frame or any other portion of the vehicle 16. The carriage 34 may be moved relative to the post 20 using any of a variety of mechanisms known in the field.

As best seen in FIG. 1, each lift column 12 also includes a control box 40 that is adapted to communicate with the other control boxes 40 in the lift system 10 by signals carried by the cables 14 to coordinate the raising and/or lowering of the vehicle 16.

Figure 2:
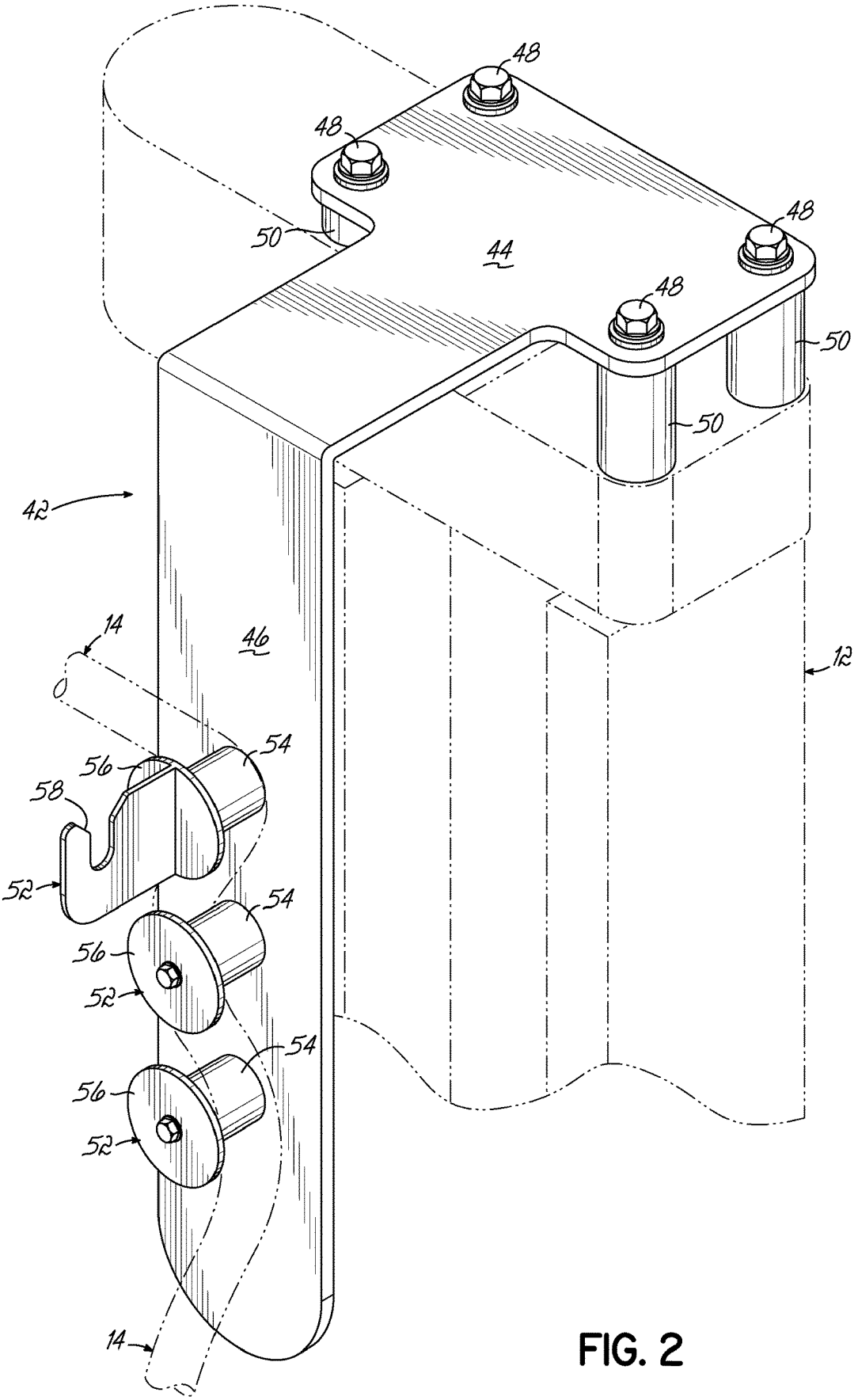
FIG. 2 is a perspective view of one embodiment of the bracket mounted on a lift column and suspending a cable according to this invention.

As shown in FIGS. 1 and 2, one aspect according to this invention is a bracket 42 which is mounted to each lift column 12 in the lift system 10. In one embodiment, the bracket 42 has a generally L-shaped configuration with a first leg 44 of the bracket 42 being generally parallel to the ground 18 and a second leg 46 of the bracket 42 extending downwardly in a perpendicular direction. The first leg 44 of the bracket 42 is a mount for selectively and/or releasably mounting the bracket 42 to an upper end of the lift column 12 via four bolts 48. The bracket 42 may be supported atop the lift column 12 by one or more spacers 50 positioned between the bracket 42 and the top of the lift column 12 as shown particularly in FIG. 2. The generally vertical second leg 46 of the bracket 42 extends downwardly from the first leg 44 and includes one or more hangers 52 adapted to support the cable 14. In the embodiment shown in FIGS. 1 and 2, each bracket 42 includes three vertically spaced hangers 52. In one embodiment, the hanger 52 may have a pedestal 54 extending perpendicularly from the leg 46 of the bracket 42. The hanger 52 may also include a disk-shaped cap 56 having an outer dimension greater than the pedestal 54 to inhibit the cable 14 from sliding off the pedestal 54.

One or more of the hangers 52 may also include a hook 58 extending outwardly from the cap 56 of the hanger 52. The hook 58 may be used for a variety of functions, including a support by which a length of the cable 14 may be suspended. While one embodiment of a hanger 52 according to this invention is shown and described, the hanger may take any of a variety of other forms, including, but not limited to, a cable grip, a cable pull, a hook, a ball stop, any of a variety of cleats (fixed, pinch, jamming, etc.), a horn, or any device capable of constraining movement of the cable 14 and/or adjusting the tension on the cable 14.

In a further embodiment, the system may include a reel, powered or otherwise, to harness the cable as needed and keep it off the ground. Other embodiments of this invention may utilize various versions of the following within the scope of this invention: cable constraints; friction-based devices to suspend cables; a ball cock around the cable for holding cables in elevated position; one or more hooks added to the post; any gripping methods that latch to cables for the purpose of suspending the cable overhead; quick release cable grips; additions to the post for the purpose of suspending or draping cables overhead; a reel to tension cables overhead; commutator devices used for the purpose of tensioning cables to be suspended overhead; pinch cleats and/or rope or other material tied to cable to create tension for the purpose of suspending cables overhead.

In one embodiment, the hangers 52 are spaced vertically from one another so that the cable 14 may be trained around the pedestals 54 of the respective hangers 52 as shown particularly in FIG. 2. One advantage of multiple hangers 52 is to increase the friction between the hangers and the cable to minimize or eliminate the likelihood that the cable 14 will slip relative to the hanger 52.

One advantageous feature of the bracket 42 and other aspects of this invention is that the brackets 42 may be added to existing lift columns as a retrofit addition thereto. Alternatively, the brackets 42 may be provided as original equipment with newly purchased lift columns.

Figure 3:
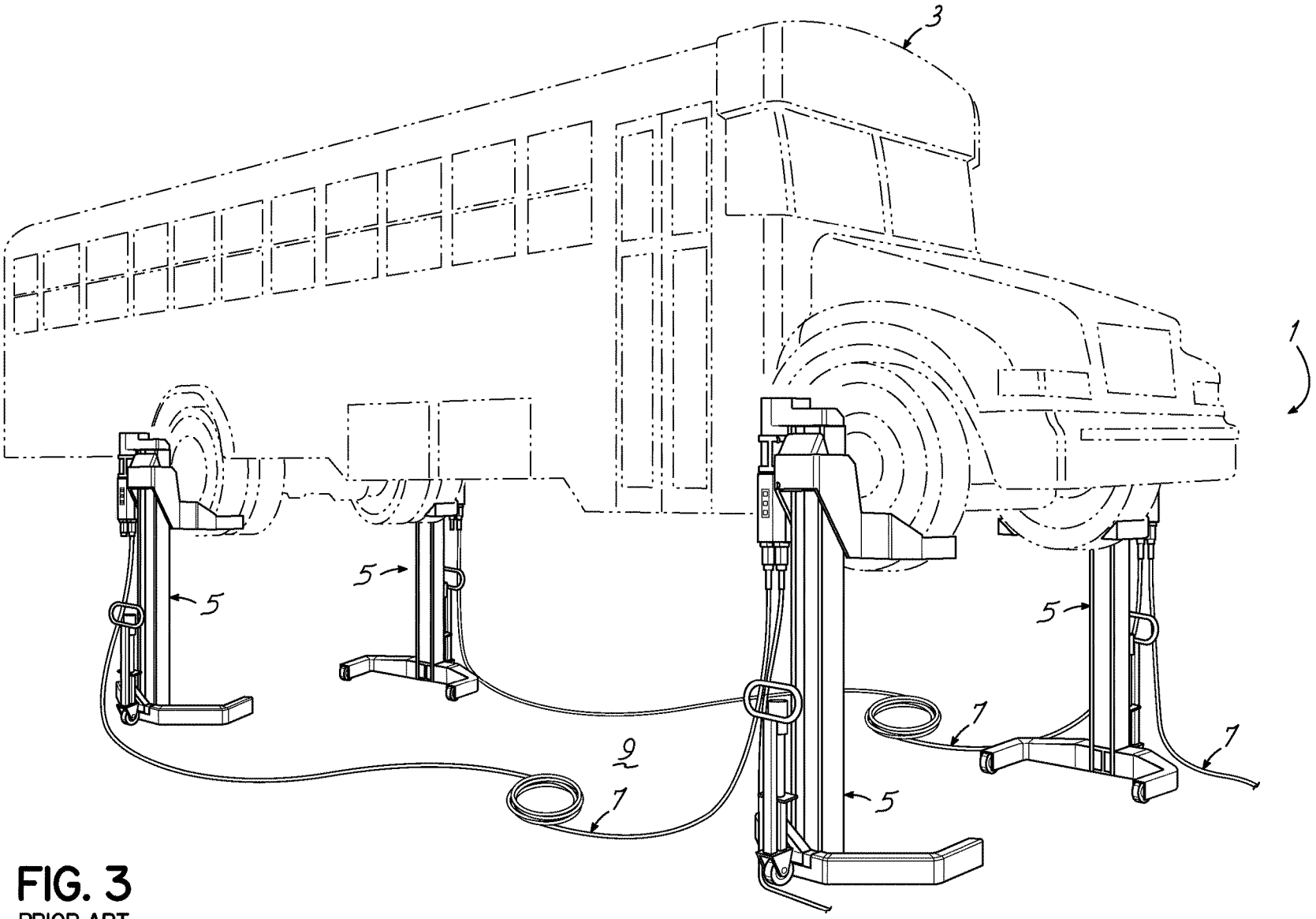
FIG. 3 PRIOR ART
FIG. 3 is a perspective view of a prior art arrangement for a lift system with the cable connecting the lift columns laying on the ground.

As a result of the brackets 42 and associated hangers 52, the cable 14 may be serially mounted to the lift columns 12 and suspended off the ground 18 as shown particularly in FIG. 1. Comparison of the cable arrangements of FIG. 1 relative to FIG. 3 shows that the tripping hazard is significantly reduced and/or eliminated with the bracket 42 and cable suspension system according to this invention as shown in FIG. 1 for personnel servicing the vehicle. Likewise, equipment can be readily driven or rolled between the lift columns 12 for servicing the vehicle 16 without interference by the cable 14 on the ground 18 according to various embodiments of this invention. While the lift columns 12 have been described and shown herein as being mobile, this invention extends to include systems with one or more fixed lift columns.

From the above disclosure of the general principles of this invention and the preceding detailed description of at least one embodiment, those skilled in the art will readily comprehend the various modifications to which this invention is susceptible. Therefore, I desire to be limited only by the scope of the following claims and equivalents thereof.

I claim:

1. A mobile lifting system comprising:

a plurality of lift columns each adapted to support a portion of a vehicle off the ground;

a cable extending between and among the plurality of lift columns; and a plurality of brackets each removably mounted to one of the lift columns and the cable being suspended on the brackets and off the ground;

wherein each of the plurality of brackets further comprises: a plurality of hangers on which the cable is positioned;

wherein each bracket further comprises: a first leg mounted proximate to an upper end of the associated lift column; and a second leg to which the cable is suspended; and wherein the first and second legs of each bracket being generally perpendicular to one another with the second leg extending downwardly from the first leg.

2. The mobile lifting system of claim 1 wherein each of the plurality of brackets is mounted proximate to an upper end of one of the lift columns.

3. The mobile lifting system of claim 1 wherein each hanger further comprises at least one of a pedestal, a cap and a hook.

4. The mobile lifting system of claim 1 wherein the cable is suspended off of the ground to and between a first, second, third and fourth lift column of the plurality of lift columns with at least the first and fourth lift columns being positioned on opposite sides of the vehicle.

5. A mobile lifting system comprising:

a plurality of lift columns each adapted to support a portion of a vehicle off the ground;

a cable extending between and among the plurality of lift columns;

a plurality of brackets each removably mounted proximate to an upper end of one of the lift columns and the cable being suspended on the brackets and off the ground;

a plurality of hangers, each hanger being on one of the plurality of brackets on which the cable is positioned; and each hanger further comprising at least one of a pedestal, a cap and a hook; wherein each bracket further comprises a plurality of the hangers;

wherein each bracket further comprises: a first leg mounted proximate to the upper end of the associated lift columns; and a second leg to which the cable in suspended; and wherein the first and second legs of each bracket being generally perpendicular to one another with the second leg extending downwardly from the first leg.

6. The mobile lifting system of claim 5 wherein the cable is suspended off the ground serially to and between a first, second, third and fourth lift column of the plurality of lift columns with at least the first and fourth lift columns being positioned on opposite sides of the vehicle.

7. A bracket for use on a mobile lift column adapted to support a portion of a vehicle off the ground, a cable being supported by the bracket off the ground for operation of the mobile lift column, the bracket comprising:

a mount for removably mounting the bracket to the mobile lift column;

a plurality of hangers for receiving the cable and suspending the cable off the ground;

a first leg adapted to be mounted proximate to an upper end of the associated lift column; and a second leg on which the hangers are located;

wherein the first and second legs are generally perpendicular to one another with the second leg extending downwardly from the first leg.

8. The bracket of claim 7 wherein a hanger of the plurality of hangers further comprises at least one of a pedestal, a cap and a hook.

9. A method comprising the steps of:

positioning a plurality of lift columns relative to a vehicle;

engaging the vehicle with the plurality of lift columns;

lifting the vehicle off the ground with the plurality of lift columns;

coordinating the lifting step via a cable extending to and between the plurality of lift columns;

suspending the cable off the ground on a plurality of brackets, each bracket being mounted to one of the plurality of lift columns;

releasably mounting each of the plurality of brackets to one of the plurality of lift columns;

wherein the suspending step further comprises: hanging the cable on a plurality of hangers each projecting from one of the brackets;

each bracket comprising; a first leg adapted to be mounted proximate to an upper end of the associated lift column; and a second leg on which the hangers are located;

when the first and second legs are generally perpendicular to one another with the second leg extending downwardly from the first leg.

10. The method of claim 9 wherein the positioning step further comprises: positioning a first set of the plurality of lift columns on a first side of the vehicle; positioning a second set of the plurality of lift columns on a second side of the vehicle spaced from the first side of the vehicle; and wherein the suspending step further comprises: extending the cable from the first side of the vehicle to the second side of the vehicle.

* * * * *